US010781024B2

(12) United States Patent
Imori et al.

(10) Patent No.: US 10,781,024 B2
(45) Date of Patent: Sep. 22, 2020

(54) METHOD FOR VACUUM PACKING HIGH-PURITY TIN AND VACUUM-PACKED HIGH PURITY TIN

(71) Applicant: JX Nippon Mining & Metals Corporation, Tokyo (JP)

(72) Inventors: Toru Imori, Ibaraki (JP); Koichi Takemoto, Ibaraki (JP); Hideaki Fukuyo, Ibaraki (JP); Shiro Tsukamoto, Ibaraki (JP); Takahiro Uchida, Ibaraki (JP); Masatomi Murakami, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 149 days.

(21) Appl. No.: 16/078,139

(22) PCT Filed: Feb. 17, 2017

(86) PCT No.: PCT/JP2017/005973
§ 371 (c)(1),
(2) Date: Aug. 21, 2018

(87) PCT Pub. No.: WO2017/145947
PCT Pub. Date: Aug. 31, 2017

(65) Prior Publication Data

US 2019/0055077 A1 Feb. 21, 2019

(30) Foreign Application Priority Data

Feb. 22, 2016 (JP) ..... 2016-031308

(51) Int. Cl.
*B65D 81/20* (2006.01)
*B65B 11/52* (2006.01)
*B65D 75/26* (2006.01)

(52) U.S. Cl.
CPC ..... *B65D 81/2023* (2013.01); *B65B 11/52* (2013.01); *B65D 75/26* (2013.01); *B65D 81/20* (2013.01); *B65D 81/2007* (2013.01)

(58) Field of Classification Search
CPC .. B65D 81/2007; B65D 81/2023; B65B 11/52
See application file for complete search history.

(56) References Cited

U.S. PATENT DOCUMENTS 3,522,077 A 7/1970 Kaczmarek
4,852,732 A * 8/1989 Wilski ..... B65D 81/26 206/204
4,896,813 A * 1/1990 Saijo ..... B23K 20/14 204/192.32
5,846,645 A 12/1998 Yokota et al.
6,000,198 A * 12/1999 Tramposch ..... B65D 81/2023 53/400
2010/0104890 A1* 4/2010 Satoh ..... C22C 38/14 428/648
2013/0213824 A1 8/2013 Tom et al.
2013/0277214 A1 10/2013 Narita et al.

FOREIGN PATENT DOCUMENTS

| | | | | |
|---|---|---|---|---|
| CN | 1300873 | A | 6/2001 | |
| CN | 103249644 | A | 8/2013 | |
| CN | 104326109 | A * | 2/2015 | |
| CN | 105173267 | A * | 12/2015 | |
| GB | 2085401 | A * | 4/1982 | ..... B65D 31/02 |
| JP | 01199877 | A | 8/1989 | |
| JP | 2001240959 | A | 9/2001 | |
| JP | 200459154 | A | 2/2004 | |
| JP | 2005298036 | A | 10/2005 | |
| JP | 2014502235 | A | 1/2014 | |
| JP | 2014167167 | A | 9/2014 | |
| KR | 100449941 | B1 | 11/2004 | |

OTHER PUBLICATIONS

Xiao (2012). Introduction to Semiconductor Manufacturing Technology (2nd Edition)—3.1.1 Bandgap. SPIE. Retrieved from https://app.knovel.com/hotlink/pdf/id:kt00BXRUQ1/introduction-semiconductor/bandgap (Year: 2012).*

Dictionary of Metals—tilt mold ingot. pp. 239-240. (2012). ASM International. Retrieved from https://app.knovel.com/hotlink/pdf/id:kt00B0K5W1/dictionary-of-metals/tilt-mold-ingot (Year: 2012).*

International Preliminary Report on Patentability dated Aug. 28, 2018, 5 pages.

Extended European Search Report for European Application No. 17756386.3 dated Dec. 10, 2018, 5 pages.

* cited by examiner

*Primary Examiner* — Nicole M. Buie-Hatcher
(74) *Attorney, Agent, or Firm* — Faegre Drinker Biddle & Reath LLP

(57) ABSTRACT

Provided is a high-purity tin product that does not contain undesirable carbonaceous impurities as a result of the following: a vacuum-packed high-purity metal article (vacuum-packed high-purity tin article) is obtained by vacuum packaging a high-purity metal (high-purity tin), at least a portion of a surface of a high-purity metal being covered with a fluorocarbon resin sheet; and the vacuum-packed high-purity metal article(vacuum-packed high-purity tin article) is obtained by vacuum packaging, with a vacuum packaging film, the high-purity metal in which at least a portion of a surface is covered with the fluorocarbon resin sheet.

12 Claims, 5 Drawing Sheets

[FIG. 1]
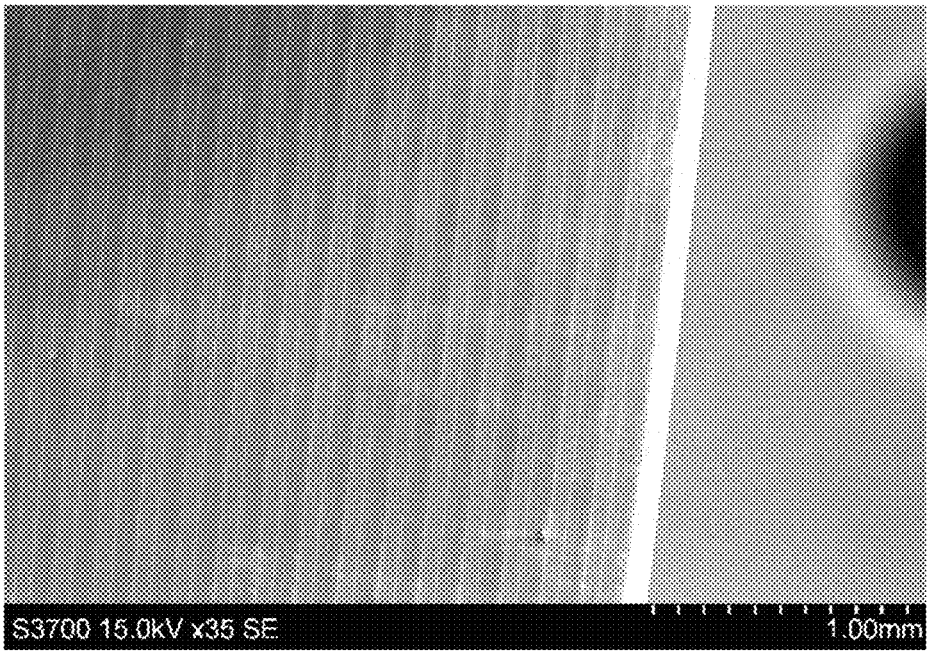

[FIG. 2]
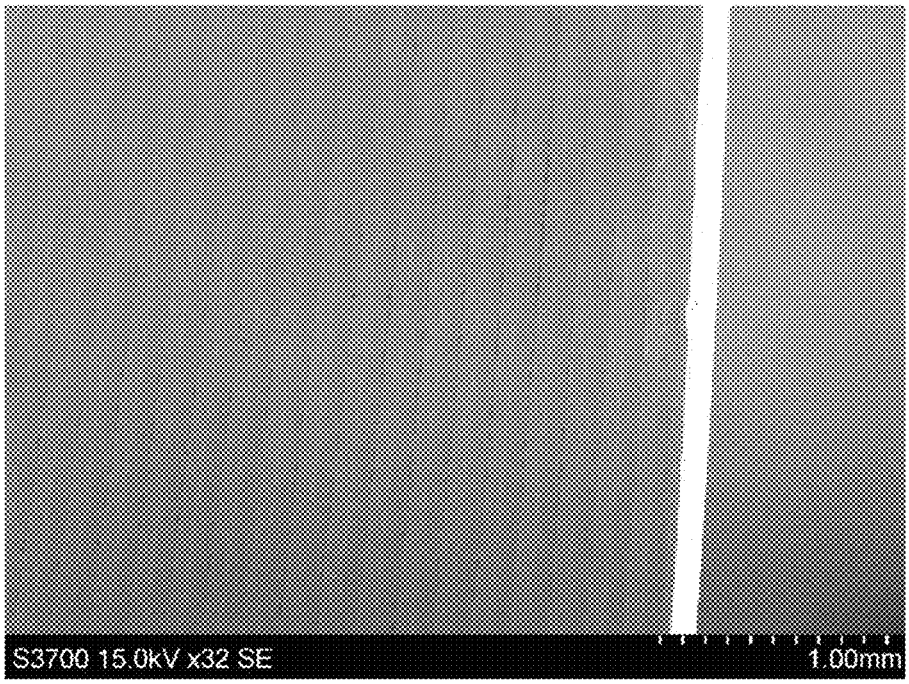

[FIG. 3A]
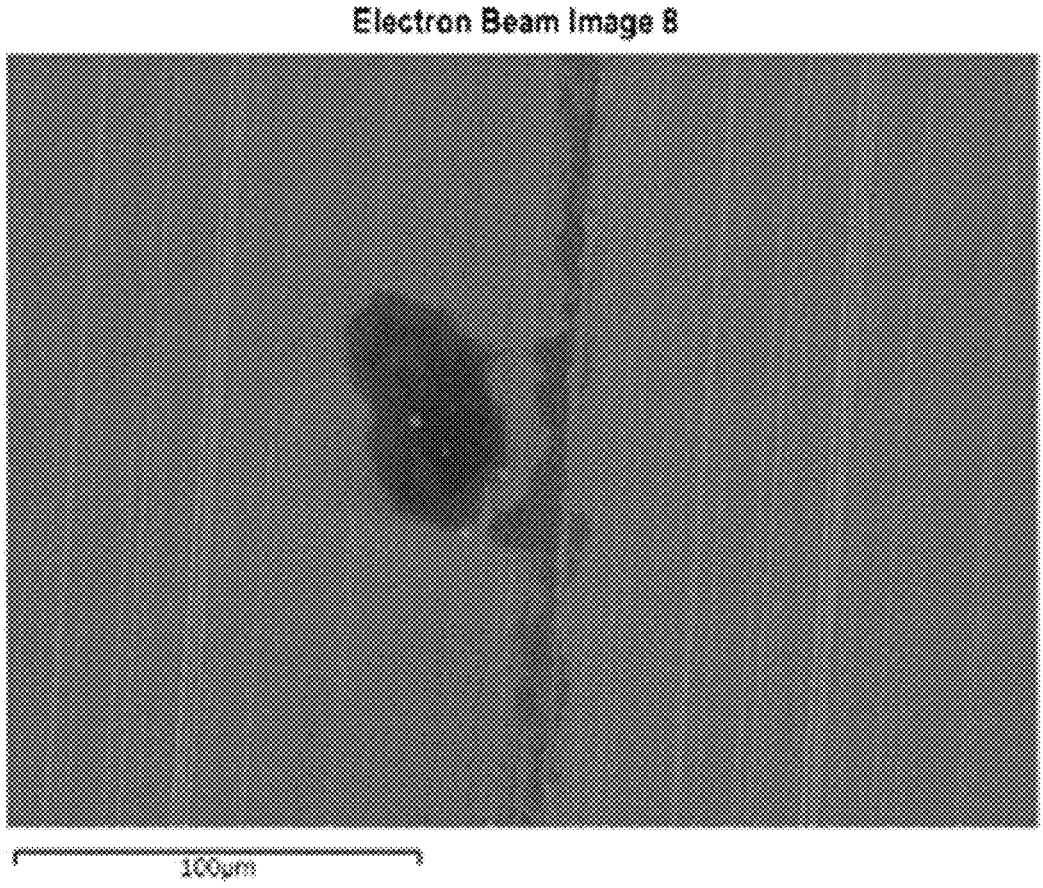

[FIG. 3B]
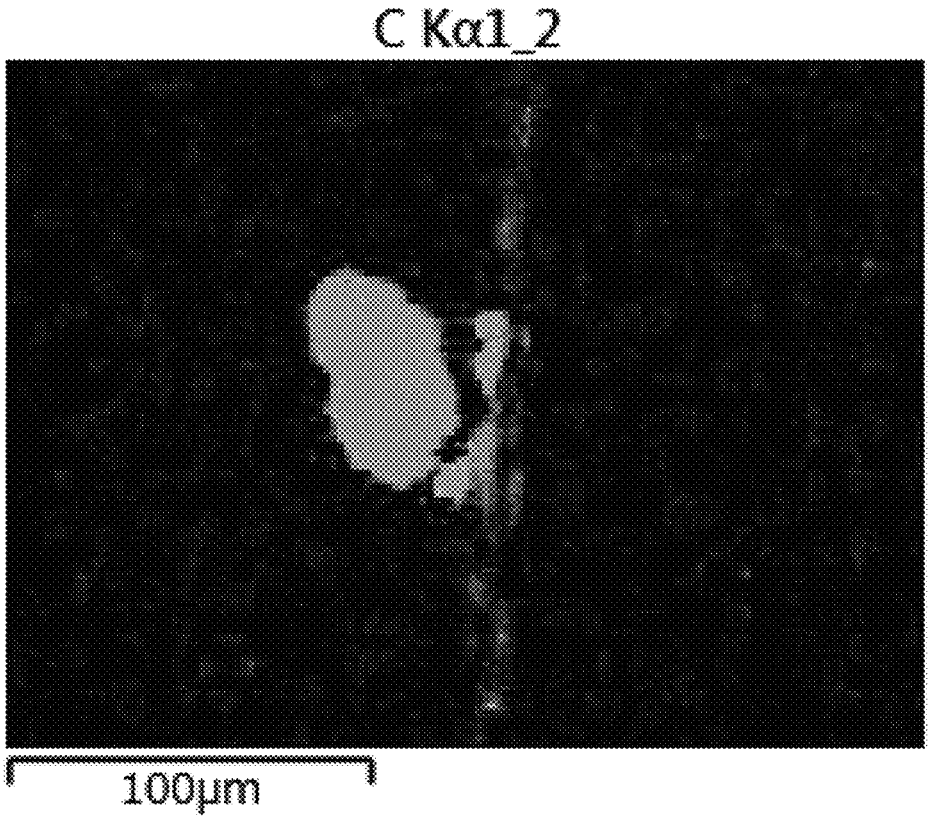

[FIG. 4]
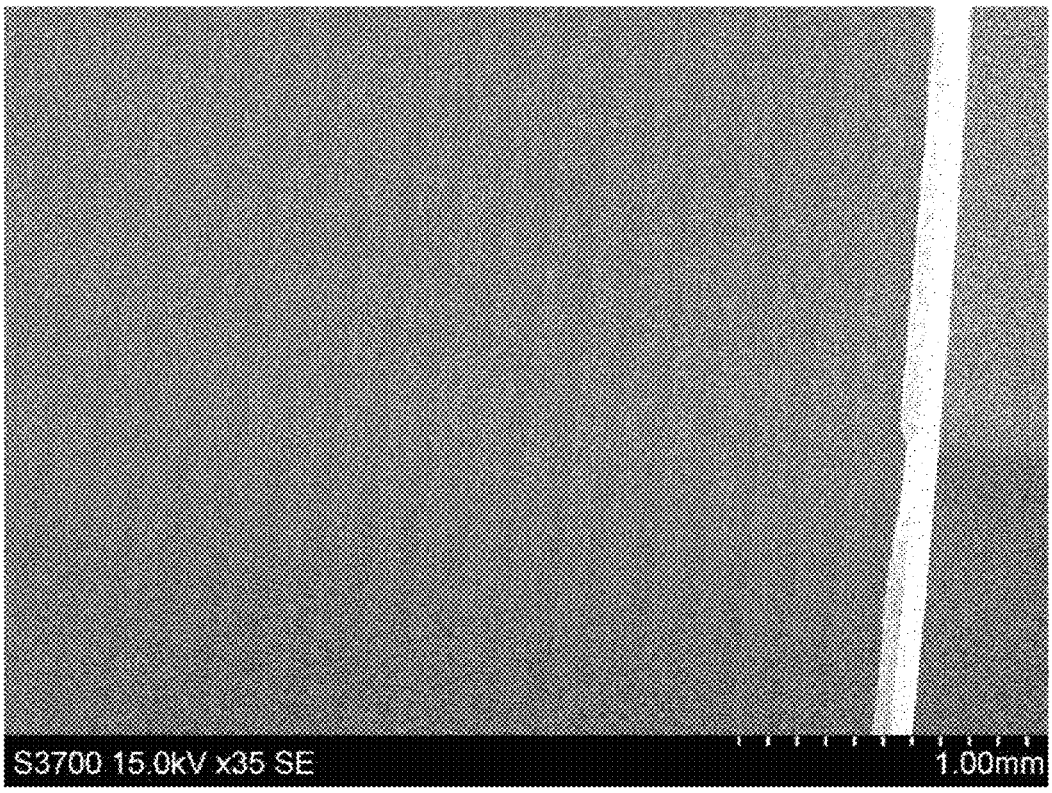

METHOD FOR VACUUM PACKING HIGH-PURITY TIN AND VACUUM-PACKED HIGH PURITY TIN

TECHNICAL FIELD

The present invention relates to a method for vacuum-packing high purity tin and a vacuum-packed high purity tin.

BACKGROUND ART

A high purity metal product that is susceptible to oxidation, such as high purity tin product, is vacuum-packed to prevent oxidation and contamination and then shipped. Polyethylene with lower oxygen permeability or aluminum vapor deposited polyethylene film is used as a vacuum packing film.

The vacuum-packed and shipped product is used after opening the packing. If washing operation such as etching is carried out after opening the vacuum packing, oxidation of the product will proceed with the operation. Therefore, the high purity metal product that is susceptible to oxidation, such as the high purity thin product, is shipped such that it can be immediately used as it is after opening the vacuum packing. For example, the product is then immediately melted and used for subsequent precision machining.

Patent Document 1 describes an art relating to a packed high purity target. It discloses that when packing the high purity target using a polyethylene bag produced by molding polyethylene with clean air having an air cleanliness of class 6 or less, the removed target can achieve both stability at the time of initiating use in sputtering and prolonged life time characteristics.

CITATION LIST

Patent Document 1: Japanese Patent Application Publication No. 2001-240959 A

SUMMARY OF INVENTION

Technical Problem

The present inventors was attempted to further purify high purity tin. However, even if the further purification was advanced, heating and melting the shipped high purity tin product often resulted in contamination of carbon impurities in the molten liquid, which caused undesirable particle formation.

It is therefore an object of the present invention to provide a high purity tin product which does not contain undesirable carbon impurities.

Solution to Problem

The present inventors was intensively studied to solve the above problems and tried to further purify the high purity tin, but could not completely avoid some degree of contamination of carbon impurities. However, the present inventors has completely changed the viewpoint of research and development and then observed the surface of the high purity tin immediately prior to heating and melting by means of an electron microscope. As a result, the present inventors have found that fine grains which are not visually observed are present, and components of the grains contain carbon when analyzed. The present inventors have then found that when vacuum-packing high purity tin by a fluorocarbon resin sheet interposed between a polyethylene sheet and tin, the high purity tin product has extremely reduced carbon deposits when opening the packing, and have completed the present invention.

Thus, the present invention includes the following aspects:

(1)

A vacuum-packed high purity metal article comprising a vacuum-packed high purity metal, wherein at least a part of a surface of the high purity metal is covered with a fluorocarbon resin sheet; and wherein the high purity metal with at least a part of the surface covered with the fluorocarbon resin sheet is vacuum-packed by a vacuum packing film.

(2)

The vacuum-packed high purity metal article according to (1), wherein the fluorocarbon resin sheet comprises a polytetrafluoroethylene (PTFE) sheet.

(3)

The vacuum-packed high purity metal article according to (1) or (2), wherein the fluorocarbon resin sheet has a thickness of from 0.05 to 5.0 mm.

(4)

The vacuum-packed high purity metal article according to any one of (1) to (3), wherein the vacuum packing film comprises a laminated film having at least one metal vapor deposited layer or at least one metal oxide vapor deposited layer, and wherein the at least one metal vapor deposited layer or the at least one metal oxide vapor deposited layer is vacuum-packed without being brought into contact with the high purity metal.

(5)

The vacuum-packed high purity metal article according to any one of (1) to (4), wherein the vacuum packing film comprises an Al vapor deposited polyethylene film; and wherein the Al vapor deposited layer is vacuum-packed without being brought into contact with the high purity metal.

(6)

The vacuum-packed high purity metal article according to any one of (1) to (5), wherein the high purity metal has a substantially columnar shape.

(7)

The vacuum-packed high purity metal article according to any one of (1) to (6), wherein the high purity metal has a surface roughness Ra in a range of from 0.3 to 5.0 μm.

(8)

The vacuum-packed high purity metal article according to any one of (1) to (7), wherein the high purity metal comprises high purity tin.

(9)

The vacuum-packed high purity metal article according to any one of (1) to (8), wherein the high purity metal has a substantially columnar shape; wherein a curved surface on a side portion of the substantially columnar shaped high purity metal is covered with a fluorocarbon resin sheet; and wherein the substantially columnar shaped high purity metal with the curved surface on the side portion covered with the fluorocarbon resin sheet is vacuum-packed by a vacuum packing film.

(11)

A method for vacuum-packing a high purity metal, the method comprising the steps of: covering at least a part of a surface of the high purity metal with a fluorocarbon resin sheet; and vacuum-packing the high-purity metal with at least a part of the surface covered with the fluorocarbon resin sheet by a vacuum packing film.

(12)

A method for producing a vacuum-packed high purity metal article comprising a vacuum-packed high purity metal, the method comprising the steps of: covering at least a part of a surface of the high purity metal with a fluorocarbon resin sheet; and vacuum-packing the high-purity metal with at least a part of the surface covered with the fluorocarbon resin sheet by a vacuum packing film.

(13)

The method according to (11) or (12), wherein the fluorocarbon resin sheet comprises a polytetrafluoroethylene (PTFE) sheet.

(14)

The method according to any one of (11) to (13), wherein the fluorocarbon resin sheet has a thickness of from 0.05 to 5.0 mm.

(15)

The method according to any one of (11) to (14), wherein the vacuum packing film comprises a laminated film having at least one metal vapor deposited layer or at least one metal oxide vapor deposited layer; and wherein the at least one metal vapor deposited layer or the at least one metal oxide vapor deposited layer is vacuum-packed without being brought into contact with the high purity metal.

(16)

The method according to any one of (11) to (15), wherein the vacuum packing film comprises an Al vapor deposited polyethylene film; and wherein the Al vapor deposited layer is vacuum-packed without being brought into contact with the high purity metal.

(17)

The method according to any one of (11) to (16), wherein the high purity metal has a substantially columnar shape.

(18)

The method according to any one of (11) to (17), wherein the high purity metal has a surface roughness Ra in a range of from 0.3 to 5.0 μm.

(19)

The method according to any one of (11) to (18), wherein the high purity metal comprises high purity tin.

(20)

The method according to any one of (11) to (19), wherein the step of covering at least a part of the surface of the high purity metal with the fluorocarbon resin sheet comprises covering a curved surface on a side portion of the substantially columnar shaped high purity metal with a fluorocarbon resin sheet, and wherein the step of vacuum-packing the high-purity metal with at least a part of the surface covered with the fluorocarbon resin sheet by the vacuum packing film comprises vacuum-packing the substantially columnar shaped high purity metal with the curved surface on the side portion covered with the fluorocarbon resin sheet, by the vacuum packing film.

Advantageous Effects of Invention

According to the present invention, a high purity metal product (a high purity tin product) containing no undesirable carbon impurities can be obtained. The vacuum-packed high purity metal product (a vacuum-packed high purity tin product) according to the present invention can be used immediately after opening the vacuum packing without washing or the like, for example, it can be immediately heated and melted to prepare a molten metal of the high purity metal (tin), and can use the vacuum-packed high purity metal product according to the present invention as a molten metal for an ultrafine processing apparatus such as an LSI or the like. The molten metal has extremely reduced carbon impurities.

BRIEF DESCRIPTION OF DRAWINGS

FIG. 1 is a SEM photograph of a surface of an opened article of high purity tin vacuum-packed via a NAFLON polytetrafluoroethylene sheet.

FIG. 2 is an SEM photograph of a surface of an opened article of high purity tin vacuum-packed directly by an Al vapor deposited polyethylene film without using a NAFLON polytetrafluoroethylene sheet.

FIG. 3A is an SEM photograph enlarged near a deposit on a surface of an opened article of high purity tin vacuum-packed directly by an Al vapor deposited polyethylene film without using a NAFLON polytetrafluoroethylene sheet.

FIG. 3B is an EDX photograph enlarged near a deposit on a surface of an opened article of high purity tin vacuum-packed directly by an Al vapor deposited polyethylene film without using a NAFLON polytetrafluoroethylene sheet.

FIG. 4 is an SEM photograph of a surface of high purity tin cut by a lathe.

DESCRIPTION OF EMBODIMENTS

Embodiments of the present invention will be described below in detail. The present invention is not limited to the embodiments described below.

[Vacuum Packing Method]

The vacuum-packed high purity metal article according to the present invention can be produced by vacuum-packing a high purity metal using a method including the steps of covering at least a part of a surface of the high purity metal with a fluorocarbon resin sheet; and vacuum-packing the high-purity metal with at least a part of the surface covered with the fluorocarbon resin sheet by a vacuum packing film.

[High Purity Metal]

The vacuum packing according to the present invention can be suitably used for high purity metals that are susceptible to oxidation. Such high purity metals include, for example, high purity tin (Sn), bismuth (Bi) and copper (Cu). Preferably, high purity Sn may be used. It is important for such a high purity metal to reduce carbon impurities, in order to use the high purity metal as it is immediately after opening the vacuum packing, for example to melt the high purity metal immediately after opening the vacuum packing, without further performing washing operation such as etching, and then employ the high purity metal according to the present invention as a molten metal. The advantage of the present invention can be provided without no particular limitation as long as the purity of the high purity metal is of such a degree that the vacuum packing is used, for example, metals having a purity such as 2N (99%), 3N (99.9%), 4N (99.99%), 5N (99.999%), and 6N (99.9999%) may be used.

[Shape of High Purity Metal]

The shape of the high purity metal is not particularly limited as long as it has a shape capable carrying out the operation of vacuum packing according to the present invention. Preferable shapes include, for example, shapes such as a substantially columnar shape, a columnar shape, a rectangular parallelepiped shape, and a cubic shape. Preferably, it may be substantially columnar. A person skilled in the art would be able to appropriately perform the vacuum packing depending on the shape of the high purity metal, by placing the fluorocarbon resin sheet along each shape to cover at least a part of the high purity metal, and vacuum-packing the high purity metal by a vacuum packing film.

[Surface Roughness of High Purity Metal]

In a preferred embodiment, the high purity metal may have a surface roughness Ra, for example in a range of from 0.3 to 5.0 μm, and preferably in a range of from 0.3 to 3.3 μm, and more preferably in a range of from 0.5 to 3.0 μm. In the present invention, the surface roughness Ra can be determined as an arithmetic mean roughness. The surface roughness Ra is preferably smaller from the viewpoint of reducing the amount of carbon deposited, but if the surface roughness Ra is too small, scratches will tend to be generated during subsequent work, so that the appearance will be deteriorated.

[Covering Step with Fluorocarbon Resin Sheet]

In the covering step with the fluorocarbon resin sheet, at least a part of the surface of the high purity metal is covered. The entire surface of the high purity metal may be covered. In order to effectively cover the high purity metal while maintaining the workability, a surface portion to which the vacuum packing film is strongly pressure-bonded during the vacuum packing is selected as at least a part of the surface to be covered, depending on the shape of the high purity metal. For example, when the high purity metal is substantially columnar, a curved surface on the side portion of the substantially columnar high purity metal is covered with the fluorocarbon resin sheet. In this case, if desired, the upper surface portion and/or the bottom surface portion of the substantially columnar high purity metal may be further covered, so that the entire surface of the substantially columnar high purity metal may be covered.

[Fluorocarbon Resin Sheet]

In a preferred embodiment, examples of the fluorocarbon resin sheet include a polytetrafluoroethylene (PTFE) sheet, a tetrafluoroethylene-perfluoroalkyl vinyl ether copolymer, tetrafluoroethylene-hexafluoropropylene copolymer (tetra/hexa-fluorinated), a tetrafluoroethylene-ethylene copolymer, poly(vinylidene fluoride) (di-fluorinated), polychlorotrifluoroethylene (tri-fluorinated), chlorotrifluoroethylene-ethylene copolymer sheets and the like. Preferably, the polytetrafluoroethylene (PTFE) sheet includes a Teflon® sheet available from Du Pont and a Naflon® sheet available from NICHIAS Corporation. In a preferred embodiment, the thickness of the fluorocarbon resin sheet may be, for example in a range of from 0.01 to 6.0 mm, or in a range of from 0.05 to 5.0 mm, preferably in a range of from 0.02 to 4.0 mm, or in a range of from 0.05 to 3.0 mm. The thickness of the fluorocarbon resin sheet in such a range can achieve both rigidity for decreasing carbon deposits and flexibility for not breaking the vacuum packing film during the vacuum packing.

[Vacuum Packing Film]

The vacuum packing film that can be used includes, but not limited to, vacuum packing films conventionally used for vacuum packing of high purity metal. The vacuum packing film to be thus used includes films with reduced oxygen permeability (oxygen barrier films) and films with reduced water vapor permeability (water vapor barrier films). Example of such vacuum packing films include resin films having increased flexibility, laminated films having a metal layer(s) and/or a metal oxide layer (s) provided by vapor deposition or the like. Examples of resin films used for such laminated films include a polyethylene film, a nylon film, and a PET film. Examples of the metal of the metal layer provided by vapor deposition or the like include Al (aluminum) and Sn. Examples of the metal oxide of the metal oxide layer include $Al_2O_3$ (aluminum oxide) and $SiO_2$ (silicon oxide). Preferably, an Al vapor deposited polyethylene film or a Sn vapor deposited polyethylene film may be used. The vacuum packing film that can be used may be a laminated film in which a layer(s) is/are further laminated on the above film, including, for example, laminated films in which polyethylene films, nylon films and/or PET films are further laminated on the surfaces of the metal layer and the metal oxide layer. Alternatively, a plurality of films (laminating films) can be appropriately stacked and vacuum packing can be carried out, if desired, in order to ensure protection during transportation, or further improve the water vapor barrier property, and the like.

[Vacuum Packing]

The vacuum packing using the vacuum packing film can be performed by a known means and under known conditions. Examples of a usable vacuum packing apparatus include KASHIWAGI type vacuum packaging machine (available from NPC Corporation), and GDP-400 (available from TAMURA SEAL CO., LTD.). In a preferred embodiment, the vacuum packing can be carried out under conditions with less particles.

[Vacuum Packed High Purity Metal Article]

The vacuum packed high purity metal article (vacuum packed high purity tin article) according to the present invention can be used immediately after opening the vacuum packing without washing or the like. For example, the vacuum packed high purity metal article according to the present invention can be used as a molten metal for an ultrafine processing apparatus such as an LSI. The molten metal has significantly decreased carbon impurities, can suppress formation of undesirable particles, and does not generate clogging of fine flow paths.

EXAMPLES

While Examples and Comparative Examples will be described below, these are merely for better understanding of the invention. The present invention is not intended to be limited by Examples or Comparative Examples.

Example 1

Commercially available bulk tin having purity 4N (99.99% by mass; excluding carbon, nitrogen, oxygen, hydrogen) was prepared.

This was cut into a columnar shape having a diameter of 50, a length of 50 mm and a surface roughness Ra of 3.0 μm by means of a lathe.

The column of tin was packed by a Naflon sheet having a thickness of 0.3 mm (available from NICHIAS Corporation) and further sandwiched by two Al vapor deposited polyethylene films (trade name DNP Technopack, available from Dai Nippon Printing Co., Ltd.) (a thickness of deposited Al of 12 μm, and a thickness of polyethylene of 80 μm) from the up and down directions, while directing the polyethylene surfaces to the inner side. Subsequently, the end portion was heated and sealed by a sealer to form a bag to be wrapped, and the vacuum packing was then carried out by heating and sealing the opening of the bag under vacuum suction at about −64 kPa. The KASHIWAGI type vacuum packaging machine was used as a vacuum packing machine.

After leaving the vacuum packed article to stand for 3 hours, it was opened and the curved surface on the side of the columnar object was observed by SEM/EDX. The results are shown in FIG. 1.

As shown in FIG. 1, the SEM (Scanning Electron Microscopy) and EDX (Energy Dispersive X-ray Spectroscopy) observations demonstrated that there was no adhesion of carbon in the opened article of high purity tin vacuum-packed via the Naflon sheet. The results are summarized in Table 1.

Examples 2 and 3

Experiments were carried out by the same method as that of Example 1, with the exception that the thickness of the Naflon sheet in Example 1 was changed. The results were summarized in Table 1 as Example 2 (a thickness of the Naflon sheet of 0.05 mm) and Example 3 (a thickness of the Naflon sheet of 3 mm).

Comparative Example 1

In Comparative Example 1, the vacuum packing was carried out by the same method as of Example 1, but without using the NAFLON polytetrafluoroethylene sheet, that is, directly by an Al vapor deposited polyethylene film, and the vacuum packed article was left to stand for 3 hours and then opened, and the curved surface on the side of the columnar object was observed by SEM/EDX. The results are shown in FIGS. 2, 3A and 3B. These results are also summarized in Table 1.

TABLE 1

| | Example 1 | Example 2 | Example 3 | Comparative Example 1 |
|---|---|---|---|---|
| Presence or absence of NAFLON polytetrafluoroethylene sheet | Present | Present | Present | Absent |
| Thickness of NAFLON polytetrafluoroethylene Sheet (mm) | 0.3 | 0.05 | 3 | — |
| Carbon Adhesion on Tin Surface | Absent | Absent | Absent | Present |

FIG. 2 is a photograph observed by SEM (scanning electron microscope) under the same conditions as those of FIG. 1 (Example 1). In FIG. 2, an increased number of vertical stripes running from the top to the bottom of the photograph are observed, which would be vertical stripes generated due to the lathe processing and would be linearly continuous projections. In the vertical stripes near the center in the left and right direction of the photograph among these vertical stripes, the deposits each having a certain lateral width spreading like a stain are observed along the vertical strips. These deposits appear to be near the top part when assuming that each strip is a continuous linear projection. The massive deposits having different shapes from those deposits along the vertical stripes are also observed near the center of the photograph. FIG. 3A is an enlarged SEM photograph of the vicinity of the former deposit, in which the deposit is clearly observed. FIG. 3B is an EDX photograph of the same field of view as that of FIG. 3A, in which it is clearly observed that the deposit is a carbon-containing deposit.

The microscopic peaks and valleys on the surface of high purity tin may be probably in the form of blades, and they would be generated when the flexible polyethylene sheet is pressure-bonded onto the peaks and valleys on the tin surface and scratches the tin surface during vacuum packing. In contrast to polyethylene, it is believed that since the NAFLON polytetrafluoroethylene sheet is rigid and has a good sliding property, it would not adhere to the tin surface.

As a result of studying candidates which may be the origin of such carbon deposits, the present inventors have concluded that the deposits are derived from the polyethylene film adhering onto the tin surface. The surface of high purity tin is sufficiently smooth when macroscopically observed, but the surface of high purity tin forms peaks and valleys which will be derived from the cutting work and the like when microscopically observed. The present inventors believe that the polyethylene film is scraped by the peaks and valleys, and fine fragments adhere due to pressure bonding during vacuum packing.

FIG. 4 is a photograph in which the surface of high purity tin cut by the lathe is observed by SEM (scanning electron microscope) under the same conditions as those of FIG. 1 (Example 1). As shown in FIG. 4, the surface of high purity tin appears to be smooth when macroscopically observed, but the surface forms peaks and valleys when microscopically observed.

Further, the vacuum packing under the same conditions as those of Example 1 was carried out using a NAFLON polytetrafluoroethylene sheet having a thickness of 10 mm. As a result, the Al vapor deposited polyethylene (a thickness of deposited Al of 12 μm; a thickness of polyethylene of 80 μm) was broken by the projections at the end of the NAFLON polytetrafluoroethylene sheet during processing after the vacuum packing. Therefore, although there is no upper limit on the thickness of the usable NAFLON polytetrafluoroethylene sheet in terms of reduction of carbon deposits, the thickness of the NAFLON polytetrafluoroethylene sheet is preferably selected so as to be a thickness to such an extent that flexibility enough not to bring about any breakage in the outer packing material due to the projections at the end portion of the NAFLON polytetrafluoroethylene sheet can be maintained, depending on the flexibility of the packing material such as the Al vapor deposited polyethylene used on the outer side of the NAFLON polytetrafluoroethylene sheet.

INDUSTRIAL APPLICABILITY

According to the present invention, a high purity metal product (a high purity tin product) containing no undesirable carbon impurities can be obtained. The present invention is an industrially useful invention.

What is claimed is:

1. A vacuum-packed high purity metal article comprising a vacuum-packed high purity metal having a purity of at least 99% by weight, wherein at least a part of a surface of the high purity metal is covered with a fluorocarbon resin sheet; and wherein the high purity metal with at least a part of the surface covered with the fluorocarbon resin sheet is vacuum-packed by a vacuum packing film;

wherein the vacuum packing film comprises a laminated film having at least one metal vapor deposited layer or at least one metal oxide vapour deposited layer, and wherein the at least one metal vapor deposited layer or the at least one metal oxide vapor deposited layer is vacuum-packed without being brought into contact with the high purity metal.

2. The vacuum-packed high purity metal article according to claim 1, wherein the fluorocarbon resin sheet comprises a polytetrafluoroethylene (PTFE) sheet.

3. The vacuum-packed high purity metal article according to claim 1, wherein the fluorocarbon resin sheet has a thickness of from 0.05 to 5.0 mm.

4. The vacuum-packed high purity metal article according to claim 1, wherein the vacuum packing film comprises an Al vapor deposited polyethylene film; and wherein the Al vapor deposited layer is vacuum-packed without being brought into contact with the high purity metal.

5. The vacuum-packed high purity metal article according to claim 1, wherein the high purity metal has a substantially columnar shape.

6. The vacuum-packed high purity metal article according to claim 1, wherein the high purity metal has a surface roughness Ra in a range of from 0.3 to 5.0 μm.

7. The vacuum-packed high purity metal article according to claim 1, wherein the high purity metal comprises high purity tin.

8. The vacuum-packed high purity metal article according to claim 1, wherein the high purity metal has a substantially columnar shape;

wherein a curved surface on a side portion of the substantially columnar shaped high purity metal is covered with a fluorocarbon resin sheet; and wherein the substantially columnar shaped high purity metal with the curved surface on the side portion covered with the fluorocarbon resin sheet is vacuum-packed by a vacuum packing film.

9. A method for producing the vacuum-packed high purity metal article of claim 1, the method comprising the steps of:

covering at least a part of a surface of the high purity metal with a fluorocarbon resin sheet; and vacuum-packing the high-purity metal with at least a part of the surface covered with the fluorocarbon resin sheet by a vacuum packing film.

10. The method according to claim 9, wherein the vacuum packing film comprises a laminated film having at least one metal vapor deposited layer or at least one metal oxide vapor deposited layer; and wherein the at least one metal vapor deposited layer or the at least one metal oxide vapor deposited layer is vacuum-packed without being brought into contact with the high purity metal.

11. The method according to claim 9, wherein the vacuum packing film comprises an Al vapor deposited polyethylene film; and wherein the Al vapor deposited layer is vacuum-packed without being brought into contact with the high purity metal.

12. The method according to claim 9, wherein the step of covering at least a part of the surface of the high purity metal with the fluorocarbon resin sheet comprises covering a curved surface on a side portion of a substantially columnar shaped high purity metal with a fluorocarbon resin sheet; and wherein the step of vacuum-packing the high-purity metal with at least a part of the surface covered with the fluorocarbon resin sheet by the vacuum packing film comprises vacuum-packing the substantially columnar shaped high purity metal with the curved surface on the side portion covered with the fluorocarbon resin sheet, by the vacuum packing film.

* * * * *